US006551163B1

(12) United States Patent
Mitchell

(10) Patent No.: US 6,551,163 B1
(45) Date of Patent: Apr. 22, 2003

(54) BUBBLE-FORMING WAND

(76) Inventor: John R. Mitchell, P.O. Box 48, Bronx, NY (US) 10461

( * ) Notice: Subject to any disclaimer, the term of this patent is extended or adjusted under 35 U.S.C. 154(b) by 0 days.

(21) Appl. No.: 10/152,482

(22) Filed: May 21, 2002

(51) Int. Cl.[7] ..... A63H 33/28
(52) U.S. Cl. ..... 446/15; 446/16
(58) Field of Search ..... 446/15, 16, 17, 446/18, 19, 20, 21

(56) References Cited

U.S. PATENT DOCUMENTS 2,514,009 A 7/1950 Raspet
2,928,205 A 3/1960 Fulton
3,326,551 A * 6/1967 Clarke
4,654,017 A 3/1987 Stein
5,135,422 A 8/1992 Bowen
5,538,454 A * 7/1996 Kessler ..... 446/236

* cited by examiner

*Primary Examiner*—Ali Abdelwahed
(74) *Attorney, Agent, or Firm*—Richard L. Miller

(57) ABSTRACT

A bubble-forming wand that includes a handle, a loop, and apparatus for attaching the loop to the handle. The loop is flexible and severed so as to from a pair of ends. In a first embodiment, the apparatus includes a tee-fitting. The pair of ends of the loop receive a lateral portion of the tee fitting, respectively, while a proximal end of the handle receives an axial portion of the tee-fitting. In a second embodiment, the apparatus includes a straight-fitting. The pair of ends of the loop receive the straight-fitting, respectively, while the proximal end of the handle is split, wraps around the straight-fitting, enters back into itself, and in so doing, captures the straight-fitting.

11 Claims, 1 Drawing Sheet

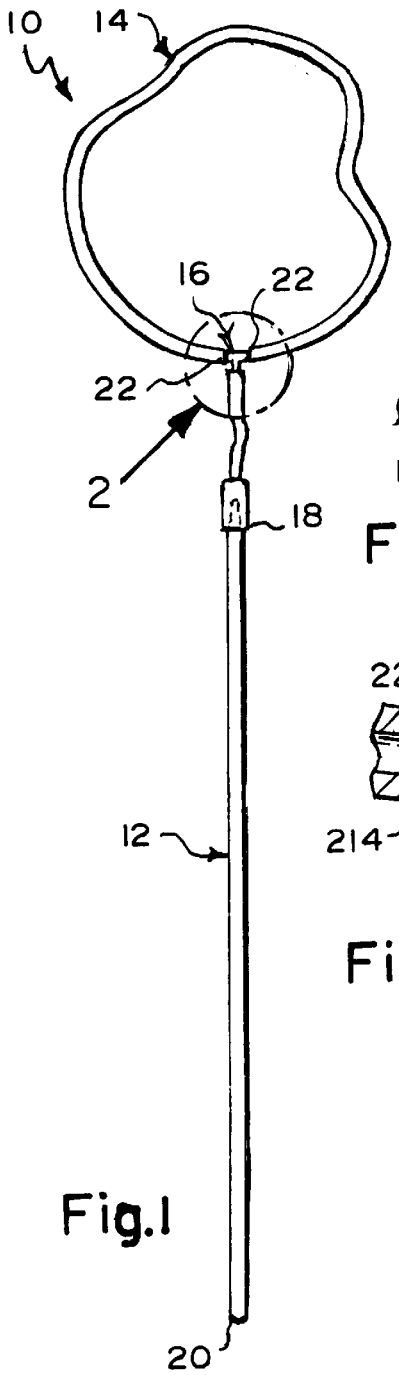
Fig.1
Fig. 6
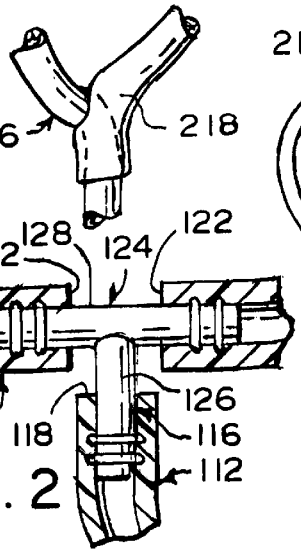
Fig. 2
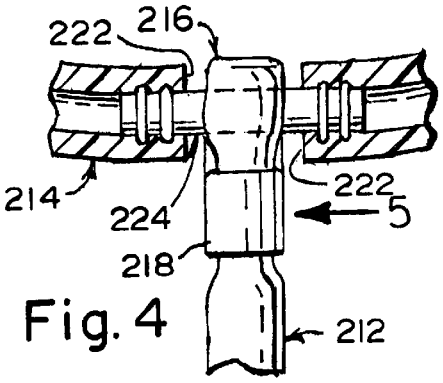
Fig. 4
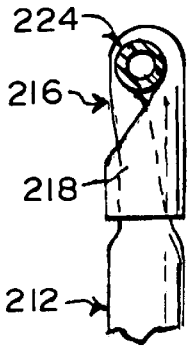
Fig. 5
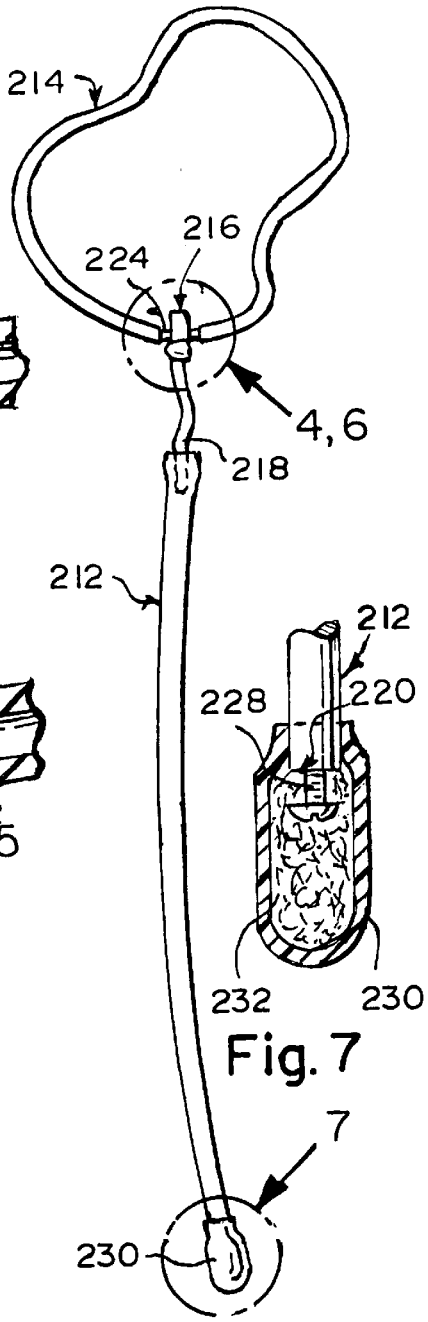
Fig. 7
Fig. 3

BUBBLE-FORMING WAND

BACKGROUND OF THE INVENTION

1. Field of the Invention

The present invention relates to a wand. More particularly, the present invention relates to a bubble-forming wand.

2. Description of the Prior Art

Numerous innovations for bubble wands have been provided in the prior art that will be described. Even though these innovations may be suitable for the specific individual purposes to which they address, however, they differ from the present invention.

A first example, U.S. Pat. No. 2,514,009 to Raspet teaches a bubble-forming wand comprising a handle, a loop on one end of the handle, said loop comprising a plurality of wires twisted together, adjacent courses of said wires contacting each other only at spaced points leaving capillary spaced therebetween.

A second example, U.S. Pat. No. 2,928,205 to Fulton teaches a bubble producing toy comprising a handle portion, a rigid rod slidably extending into said handle portion, a weight secured to the outer end portion of said rod to encourage the movement of said rod from said handle when subjected to centrifugal or inertial forces, and a continuous wick strand having no ends and having one point operatively secured to said handle portion and a second point operatively secured to said rod; the length of the wick strand between the two points of the wick strand being less than that of the length of said rod and less than one-half the length of the wick strand.

A third example, U.S. Pat. No. 4,654,017 to Stein teaches an apparatus for "Forming and Controlling Large Volume Bubbles" that consists essentially of four elements: First, a bubble-forming loop made of a flexible, large pore (substantially noncapillary) material able to store large quantities of bubble solution by adhesion to a large surface area, by formation of numerous small reservoirs in the large pores, and by surface tension in the solution film enclosing the loop material, the film uniting with the solution stored within and able to release the solution quickly to an expanding bubble; second, rod member for supporting the bubble-forming loop; third, slide member for controllably opening and closing the bubble-forming loop while minimizing reliance on inertial or centrifugal forces; and fourth, reservoir for maximizing continuity of supply of solution to the bubble-forming loop. Soap bubbles up to eight feet across have been made with the apparatus.

A fourth example, U.S. Pat. No. 5,135,422 to Bowen teaches a bubble wand toy for use with a soap solution. The bubble wand toy includes a tubular handle formed from a substantially rigid tubular plastic. A flexible tubular material is bent into a loop and the opposed ends of the loop are inserted into an end of the tubular handle. The relative dimensions of the flexible tubular loop and the tubular handle are such that the opposed ends of the tubular loop are frictionally retained in the tubular handle. An adhesive or sealant may be disposed at the interface of the tubular loop and the tubular handle to retain the tubular loop and handle together and to prevent a flow of soap solution through the tubular handle. An outer collar may be disposed over the tubular handle generally at the interface of the loop and the handle to prevent a flow of soap solution along the outside of the tubular handle. A closure may be disposed at the opposed end of the tubular handle and a flanged collar may be disposed over the tubular handle intermediate its length to further prevent a flow of soap solution along the length of the handle.

It is apparent that numerous innovations for bubble wands have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

Accordingly, an object of the present invention is to provide a bubble-forming wand that avoids the disadvantages of the prior art.

Another object of the present invention is to provide a bubble-forming wand that is simple and inexpensive to manufacture.

Still another object of the present invention is to provide a bubble-forming wand that is simple to use.

Briefly stated, still yet another object of the present invention is to provide a bubble-forming wand that includes a handle, a loop, and apparatus for attaching the loop to the handle. The loop is flexible and severed so as to from a pair of ends. In a first embodiment, the apparatus includes a tee-fitting. The pair of ends of the loop receive a lateral portion of the tee fitting, respectively, while a proximal end of the handle receives an axial portion of the tee-fitting. In a second embodiment, the apparatus includes a straight-fitting. The pair of ends of the loop receive the straight-fitting, respectively, while the proximal end of the handle is split, wraps around the straight-fitting, enters back into itself, and in so doing, captures the straight-fitting.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawing are briefly described as follows:

FIG. 1 is a diagrammatic top plan view of a first embodiment of the present invention;

FIG. 2 is an enlarged diagrammatic cross sectional view of the area generally enclosed by the dotted curve identified by arrow 2 in FIG. 1;

FIG. 3 is a diagrammatic top plan view of a second embodiment of the present invention;

FIG. 4 is an enlarged diagrammatic cross sectional view of the area generally enclosed by the dotted curve identified by arrow 4 in FIG. 3;

FIG. 5 is a diagrammatic side elevational view taken generally in the direction of arrow 5 in FIG. 4;

FIG. 6 is an enlarged diagrammatic cross sectional view of the area generally enclosed by the dotted curve identified by arrow 6 in FIG. 3; and FIG. 7 is an enlarged diagrammatic cross sectional view of the area generally enclosed in the dotted curve identified by arrow 7 in FIG. 3.

LIST OF REFERENCE NUMERALS UTILIZED IN THE DRAWING 10 bubble-forming wand of present invention
12 handle
14 loop
16 apparatus for attaching loop 14 to handle 12
18 proximal end of handle 12
20 distal end of handle 12
22 pair of ends of loop 14

First Embodiment of Apparatus 116

112 handle
114 loop
118 proximal end of handle 12
122 pair of ends of loop 14
124 tee-fitting
126 axial portion of tee-fitting 124
128 lateral portion of tee-fitting 124

Second Embodiment of Apparatus 216

212 handle
214 loop
218 proximal end of handle 212
222 pair of ends of loop 214
224 staight-fitting
228 screw of distal end 220 of handle 212
230 cap of distal end 220 of handle 212
232 silicon of distal end 220 of handle 212

DETAILED DESCRIPTION OF THE PREFERRED EMBODIMENT

Referring now to the figures, in which like numerals indicate like parts, and particularly to FIG. 1, the bubble-forming wand of the present invention is shown generally at 10.

The bubble-forming wand 10 comprises a handle 12, a loop 14 that is attached to the handle 12, and apparatus 16 for attaching the loop 14 to the handle 12.

The handle 12 is slender, elongated, tubular, and has a proximal end 18 and a distal end 20 that is free.

The loop 14 is slender, elongated, tubular, flexible, and severed so as to from a pair of ends 22.

The loop 14 is made of rubber having a hardness of 35 derometers ±5.

The configuration of a first embodiment of the apparatus 116 can best be seen in FIG. 2, and as such, will be discussed with reference thereto.

The apparatus 116 comprises a tee-fitting 124 that has an axial portion 126 and a lateral portion 128 that extends transversely across the axial portion 126 thereof.

The pair of ends 122 of the loop 114 receive the lateral portion 128 of the tee fitting 124, respectively.

The proximal end 118 of the handle 112 receives the axial portion 126 of the tee-fitting 124.

The configuration of a second embodiment of the apparatus 216 can best be seen in FIGS. 4–6, and as such, will be discussed with reference thereto.

The apparatus 216 comprises a straight-fitting 224.

The pair of ends 222 of the loop 214 receive the straight-fitting 224, respectively.

The proximal end 218 of the handle 212 is split, wraps around the straight-fitting 224, and enters back into itself, and in so doing, captures the straight-fitting 224.

The distal end 220 of the handle 212 comprises a screw 228 that extends partially axially therein, and a cap 230 that extends over the screw 228, and which is maintained thereon by being filled with silicon 232 that captures the screw 228.

It will be understood that each of the elements described above, or two or more together, may also find a useful application in other types of constructions differing from the types described above.

While the invention has been illustrated and described as embodied in a bubble-forming wand, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A bubble-forming wand, comprising:

a) a handle;

b) a loop; and c) means for attaching said loop to said handle;

wherein said loop is attached to said handle, wherein said handle is slender;

wherein said handle is elongated;

wherein said handle is tubular;

wherein said handle has a proximal end;

wherein said handle has a distal end; and wherein said distal end of said handle is free, wherein said loop is slender;

wherein said loop is elongated;

wherein said loop is tubular;

wherein said loop is flexible; and wherein said loop is severed so as to from a pair of ends, wherein said means comprises a straight-fitting, wherein said proximal end of said handle is split, wraps around said straight-fitting, enters back into itself, and in so doing, captures said straight-fitting.

2. The wand as defined in claim 1, wherein said loop is made of rubber having a hardness of 35 derometers ±5.

3. The wand as defined in claim 1, wherein said means comprises a tee-fitting;

wherein said tee-fitting has an axial portion;

wherein said tee-fitting has a lateral portion; and wherein said lateral portion of said tee-fitting extends transversely across said axial portion thereof.

4. The wand as defined in claim 3, wherein said pair of ends of said loop receive said lateral portion of said tee fitting, respectively.

5. The wand as defined in claim 3, wherein said proximal end of said handle receives said axial portion of said tee-fitting.

6. The wand as defined in claim 1, wherein said pair of ends of said loop receive said straight-fitting, respectively.

7. A bubble-forming wand, comprising:

a) a handle;

b) a loop; and c) means for attaching said loop to said handle;

wherein said loop is attached to said handle, wherein said handle is slender;

wherein said handle is elongated;

wherein said handle is tubular;

wherein said handle has a proximal end;

wherein said handle has a distal end; and wherein said distal end of said handle is free, wherein said loop is slender;

wherein said loop is elongated;

wherein said loop is tubular;

wherein said loop is flexible; and wherein said loop is severed so as to from a pair of ends, wherein said distal end of said handle comprises a screw;

wherein said screw extends partially axially in said distal end of said handle;

wherein said distal end of said handle comprises a cap;

wherein said cap extends over said screw;

wherein said cap is maintained on said screw by being filled with silicon; and wherein said silicon captures said screw.

8. The wand as defined in claim 7, wherein said loop is made of rubber having a hardness of 35 derometers ±5.

9. The wand as defined in claim 7, wherein said means comprises a tee-fitting;

wherein said tee-fitting has an axial portion;

wherein said tee-fitting has a lateral portion; and wherein said lateral portion of said tee-fitting extends transversely across said axial portion thereof.

10. The wand as defined in claim 7, wherein said pair of ends of said loop receive said lateral portion of said tee fitting, respectively.

11. The wand as defined in claim 7, wherein said proximal end of said handle receives said axial portion of said tee-fitting.

* * * * *